US011363847B1

(12) United States Patent
Martin

(10) Patent No.: US 11,363,847 B1
(45) Date of Patent: Jun. 21, 2022

(54) HAIR AUGMENTATION SYSTEM

(71) Applicant: Jennifer Ann Martin, Coconut Creek, FL (US)

(72) Inventor: Jennifer Ann Martin, Coconut Creek, FL (US)

( * ) Notice: Subject to any disclaimer, the term of this patent is extended or adjusted under 35 U.S.C. 154(b) by 137 days.

(21) Appl. No.: 16/294,542

(22) Filed: Mar. 6, 2019

Related U.S. Application Data

(60) Provisional application No. 62/696,583, filed on Jul. 11, 2018.

(51) Int. Cl.
*A41G 5/00* (2006.01)

(52) U.S. Cl.
CPC ..... *A41G 5/0073* (2013.01); *A41G 5/002* (2013.01); *A41G 5/0026* (2013.01); *A41G 5/0046* (2013.01)

(58) Field of Classification Search
CPC ..... A41G 5/00; A41G 5/0046; A41G 5/0073; A41G 5/0006; A41G 5/0013; A41G 5/0026; A41G 5/002; A41G 6/004; A41G 3/00; A41G 3/0008; A41G 3/0033; A41G 3/0041
See application file for complete search history.

(56) References Cited

U.S. PATENT DOCUMENTS

| | | | | |
|---|---|---|---|---|
| 5,592,957 | A * | 1/1997 | Gazerro | A41G 3/00 132/201 |
| 2009/0255547 | A1* | 10/2009 | Starks | A41G 3/00 132/201 |
| 2010/0170523 | A1* | 7/2010 | DePalma | A41G 3/0041 132/54 |
| 2014/0326263 | A1* | 11/2014 | Miyatake | A41G 3/00 132/54 |
| 2016/0015107 | A1* | 1/2016 | Sehovic | A41G 5/0073 132/201 |

* cited by examiner

*Primary Examiner* — Cris L. Rodriguez
*Assistant Examiner* — Brianne E Kalach
(74) *Attorney, Agent, or Firm* — John Rizvi; John Rizvi, P.A.—The Patent Professor

(57) ABSTRACT

A hair augmentation system is provided including a main portion. A clip notch may be provided in the main portion. A removable clip portion may complement the clip notch in the main portion. The main portion and the clip portion together may have a concave inner surface and a convex outer surface. At least one hair clip may be provided on the inner surface of each of the main portion and the clip portion. A flap cavity may be provided in the main portion. A hair flap may be provided on the main portion at the flap cavity. At least one hair comb may be provided on the hair flap. Imitation hair may be provided on the outer surface of the main portion.

15 Claims, 9 Drawing Sheets

HAIR AUGMENTATION SYSTEM

CROSS-REFERENCE TO RELATED APPLICATION

This application claims the benefit of U.S. Provisional Patent Application Ser. No. 62/696,583, filed Jul. 11, 2018, which is incorporated herein in its entirety.

FIELD OF THE INVENTION

The present invention relates generally to hairstyling accessories, and more particularly, to a hair augmentation system which covers and extends the appearance of a wearer's own natural hair without having to necessarily configure the wearer's natural hair to a desired hairstyle.

BACKGROUND OF THE INVENTION

Hair styling accessories which replace or augment a wearer's natural hair are well-known in the art. For example, wigs and hairpieces are commonly used to supplement the natural hair of a wearer or to replace the lost natural hair of a wearer. Wigs and hairpieces are commonly worn by chemotherapy patients who lose their natural hair during treatment. Other persons wear wigs and hairpieces to supplement or replace natural hair which has been lost due to male or female pattern baldness or alopecia.

Some wearers use hair styling accessories to facilitate a wide variety of hairstyles which may not otherwise be possible using the wearer's natural hair. Additionally, use of wigs and other types of hairpieces may enable some wearers to adopt buns, ponytails and other hairstyles in an easier and more expeditious manner than can be achieved using the wearer's natural hair. Moreover, in the event that a wearer is naturally endowed with thin hair, the wearer can use wigs and hairpieces to create the appearance of a fuller head of hair.

Some wearers may normally wear short natural hair. In some circumstances, however, the wearer may desire to adopt a longer hairstyle or a hairstyle which includes a bun, ponytail or other hair feature for a social or other occasion. In such cases, the wearer may not have sufficient time to grow the hair which is necessary to adopt the desired hairstyle in time for the occasion.

Accordingly, there is an established need for a solution to at least one of the aforementioned problems. For example, there is a need for an artificial ponytail solution which covers and extends the appearance of a wearer's own natural hair without having to necessarily configure the wearer's natural hair to a desired hairstyle.

SUMMARY OF THE INVENTION

The present invention is directed to a hair augmentation system which covers and extends the appearance of a wearer's own natural hair without having to necessarily configure the wearer's natural hair to a desired hairstyle. The hair augmentation system may include a main portion. A wedge-shaped clip notch may be provided in the main portion. A removable clip portion may complement the clip notch in the main portion. When the clip portion is inserted in the clip notch in the main portion, the main portion and the clip portion may together have a circular dish shape with a concave inner surface and a convex outer surface. Multiple hair clips may be provided on the inner surfaces of the main portion and the clip portion. A flap cavity in the main portion may extend from the clip notch. A hair flap may be attached to the main portion at the flap cavity. A hair comb may be provided at the flap cavity, on or adjacent to the hair flap. Imitation hair having a selected color, coarseness and thickness may be attached to the outer surface of the main portion.

In typical application, the main portion may be attached to the natural hair of a wearer using the hair clips and the hair comb. The clip portion may be inserted in the clip notch in the main portion and attached to the wearer's natural hair. The imitation hair may cover the natural hair of the wearer, or alternatively, may be mixed with the wearer's natural hair to achieve a desired hairstyle fullness and appearance. In some embodiments, the imitation hair attached to the main portion may be styled in the form of a bun, ponytail or other hair feature either before or after application of the hair augmentation system to the wearer's natural hair.

Introducing an illustrative embodiment of the invention, the present invention includes a hair augmentation system which covers and extends the appearance of a wearer's own natural hair without having to necessarily configure the wearer's natural hair to a desired hairstyle, comprising:

- a main portion;
- a clip notch in the main portion;
- a removable clip portion complementing the dip notch in the main portion, the main portion and the clip portion together having a concave inner surface and a convex outer surface;
- at least one hair clip on the inner surface of at least one of the main portion and the clip portion;
- a flap cavity in the main portion; and
- a hair flap on the main portion at the flap cavity.

In a second aspect, the hair augmentation system can further include at least one hair comb at the flap cavity, on or adjacent to the hair flap.

In another aspect, the hair augmentation system can further include imitation hair on the outer surface of the main portion.

In another aspect, the main portion and the clip portion may together have a circular dish shape.

In another aspect, the main portion may have a main portion panel with a semicircular or arcuate main portion outer edge.

In another aspect, the clip notch in the main portion may be wedge-shaped with pair of angled notch edges extending from the main portion outer edge.

In another aspect, the flap cavity may be generally square or rectangular.

In another aspect, the flap cavity may communicate with the clip notch.

In another aspect, the hair flap may be attached to the convex outer surface of the main portion at the flap cavity.

In another aspect, the clip portion may be generally wedge-shaped with a curved or arcuate clip portion outer edge, a pair of clip portion side edges extending from the clip portion outer edge and a clip portion inner edge extending between the clip portion side edges.

In another aspect, the at least one hair clip on the inner surface of each of the main portion and the clip portion comprises a plurality of hair clips adjacent to the main portion outer edge of the main portion.

In another aspect, the at least one hair clip on the inner surface of each of the main portion and the clip portion comprises a plurality of hair clips adjacent to the clip portion outer edge and at least one hair clip adjacent to the clip portion inner edge of the clip portion.

Introducing another embodiment of the invention, the present invention includes a hair augmentation system which covers and extends the appearance of a wearer's own natural hair without having to necessarily configure the wearer's natural hair to a desired hairstyle, comprising:

a main portion;

a clip notch in the main portion;

a removable clip portion complementing the clip notch in the main portion, the main portion and the clip portion together having a concave inner surface and a convex outer surface;

at least one hair clip on the inner surface of at least one of the main portion and the clip portion;

a flap cavity in the main portion; and a hair flap on the main portion at the flap cavity.

As another example, disclosed is a hair augmentation system, comprising, a main portion, a clip notch in the main portion, a removable clip portion complementing the clip notch in the main portion, at least one hair clip on an inner surface of at least one of the main portion and the clip portion.

In another aspect, the hair augmentation system further includes imitation hair on both of the main portion and the clip portion.

In another aspect; the main portion and the clip portion are configured to fit together such that a space remains between the clip portion and the main portion, the space configured to receive a wearer's own hair between the main portion and the clip portion.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a hair augmentation system which covers and extends the appearance of a wearer's own natural hair without having to necessarily configure the wearer's natural hair to a desired hairstyle.

Figure 1:
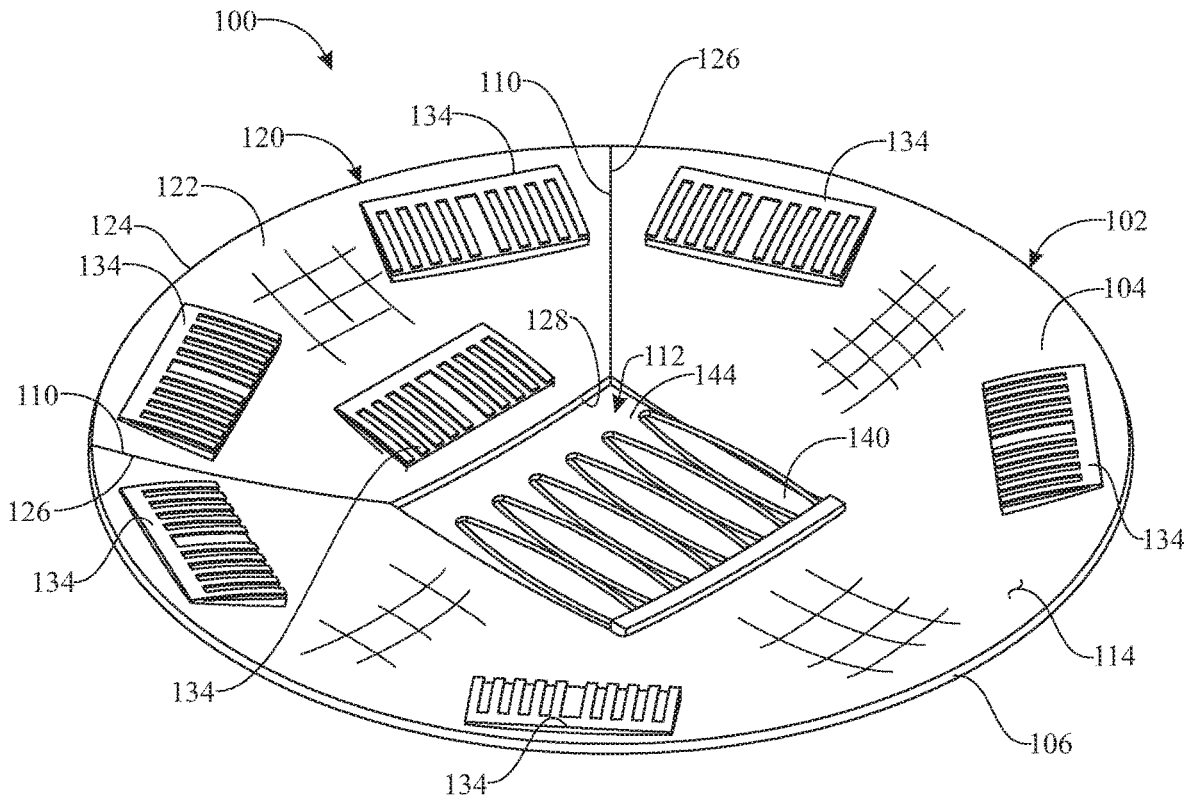
FIG. 1 presents a front perspective view showing a main portion and a complementary clip portion of a first illustrative embodiment of the hair augmentation system of the present invention.
Figure 2:
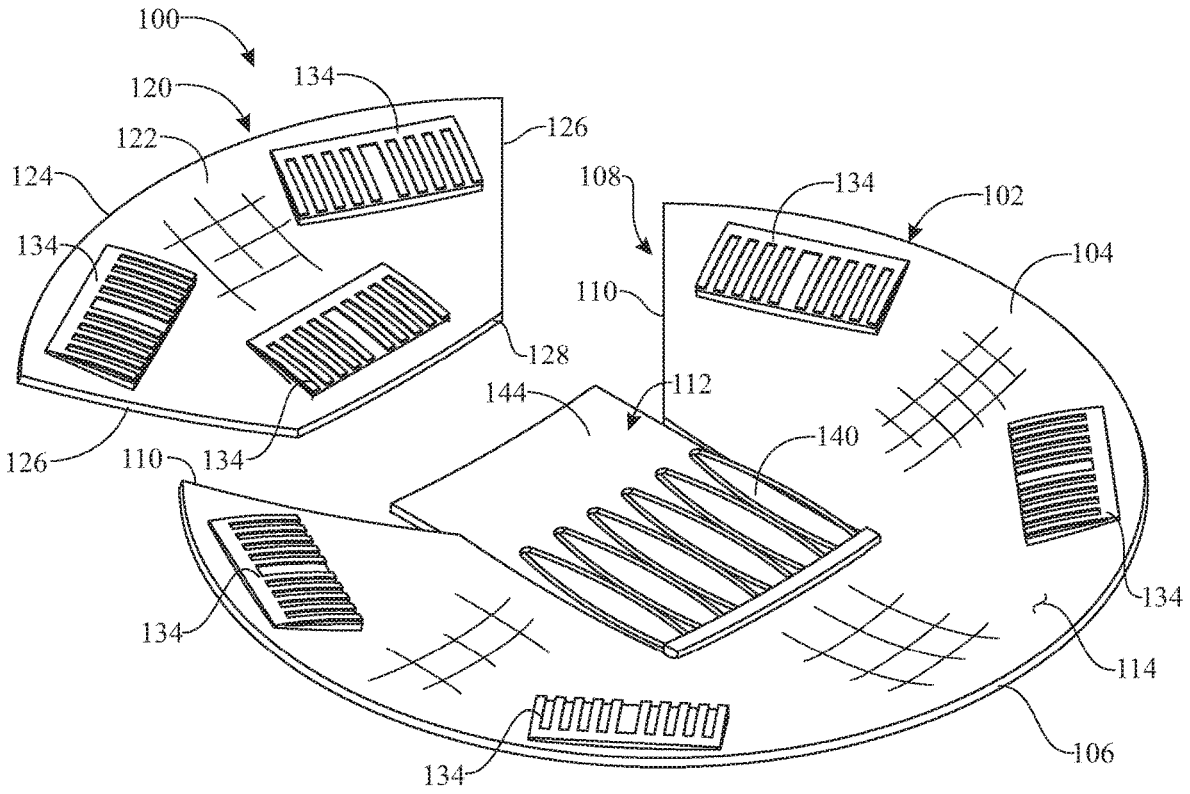
FIG. 2 presents a front exploded perspective view showing the clip portion detached from the clip notch in the main portion of the first illustrative embodiment of the hair augmentation system of the present invention.

Referring initially to FIGS. 1-8, a hair augmentation system 100 is illustrated in accordance with an exemplary embodiment of the present invention. As shown, the hair augmentation system 100 may include a main portion 102. The main portion 102 may include a main portion panel 104. The main portion panel 104 may be fabricated of a mesh-type fabric material and/or other flexible material(s). The main portion panel 104 may have a semicircular, curved or arcuate main portion outer edge 106. As illustrated in FIG. 2, a clip notch 108 may extend into the main portion panel 104. In some embodiments, the clip notch 108 may be wedge-shaped with a pair of angled notch edges 110 which extend from the main portion outer edge 106.

A flap cavity 112 may be provided in the main portion panel 104 of the main portion 102. The flap cavity 112 may communicate with the clip notch 108 inwardly of the notch edges 110. In some embodiments, the flap cavity 112 may be generally square or rectangular, as illustrated.

Figure 3:
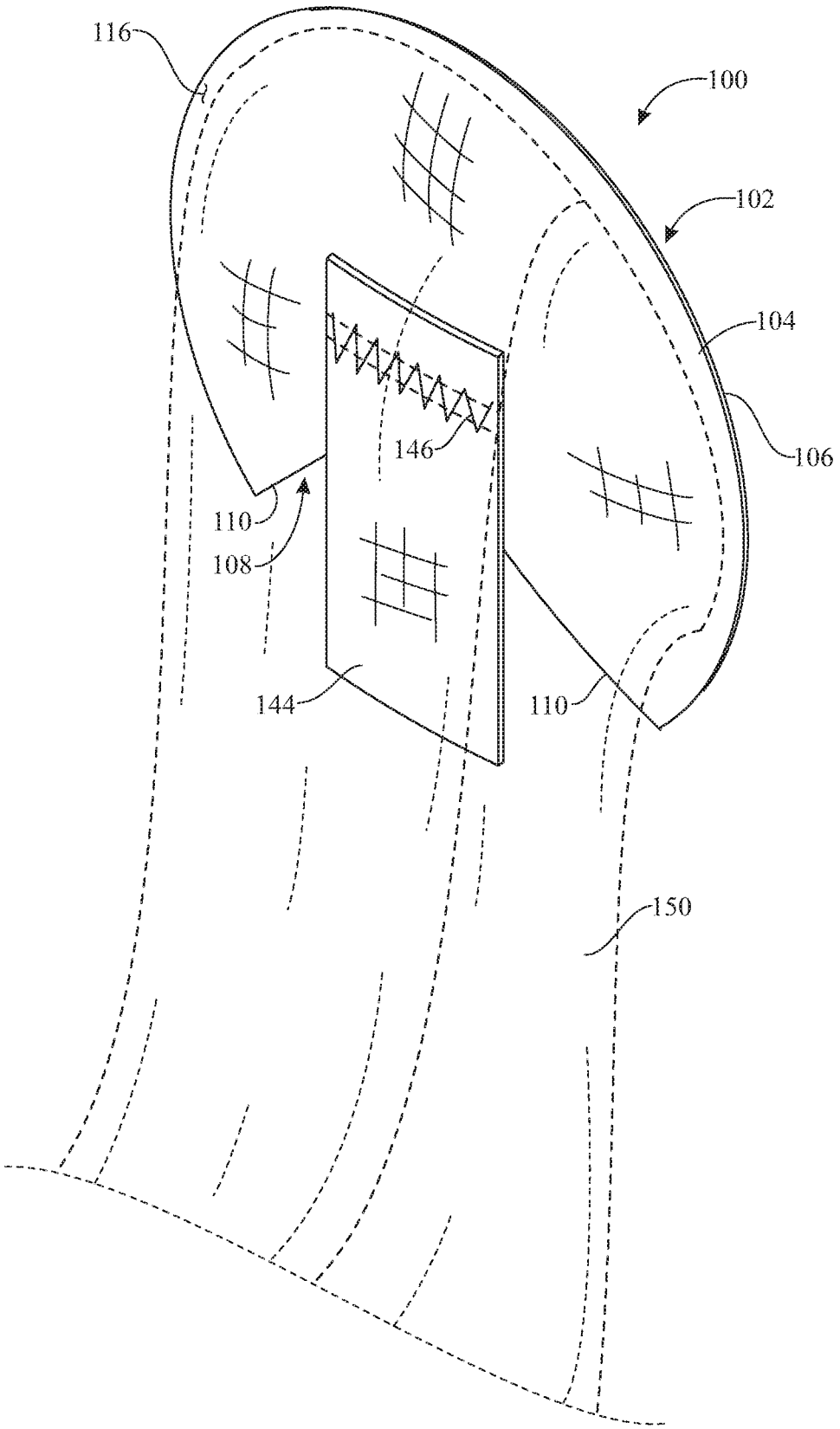
FIG. 3 presents a rear perspective view of the first illustrative embodiment of the hair augmentation system of the present invention, with imitation hair attached to the concave outer surface of the main portion.

As best shown in the exploded view of FIG. 2, a removable clip portion 120 may be formed in a shape and size such that the removable clip portion 120 complements or fills the clip notch 108 in the main portion 102. As illustrated in FIG. 1, when the clip portion 120 is inserted in the clip notch 108 (FIG. 2) of the main portion 102, the main portion 102 and the clip portion 120 may together have a circular dish or bowl shape with a concave inner surface 114 and a convex outer surface 116 (FIG. 3). The clip portion 120 may include a clip portion panel 122 which may be fabricated of a mesh-type fabric material and/or other flexible material(s). The clip portion panel 122 may be wedge-shaped and may have a curved or arcuate clip portion outer edge 124, a pair of clip portion side edges 126 which extend from the clip portion outer edge 124 and mate with the respective notch edges 110 of the clip notch 108 in the main portion 102, and a clip portion inner edge 128 extending between the clip portion side edges 126.

As shown in FIG. 1, at least one hair clip 134 may be provided on the inner surface 114 of each of the main portion 102 and the clip portion 120. In some embodiments, multiple hair clips 134 may be provided on the inner surface 114 adjacent to the main portion outer edge 106 of the main portion 102. Multiple hair clips 134 may in like manner be provided on the inner surface 114 adjacent to the clip portion outer edge 124 of the clip portion 120.

As shown in FIG. 2, a hair flap 144 may be attached to the main portion 102 at the flap cavity 112. At least one hair comb 140 may be provided on the hair flap 144. In some embodiments, the at least one hair comb 140 may include at least one 6-prong hair comb, as shown. As illustrated in FIG. 3, in some embodiments, the hair flap 144 may be attached to the outer surface 116 of the main portion 102 via a flap stitching 146 arranged substantially at one end of the hair flap 144. The flap stitching 146 defines a hinge and the hair flap 144 is capable of pivoting with respect to the main portion panel 104 of the main portion 102, about the hinge or flap stitching 146, to cover and uncover the flap cavity 112.

Figure 4:
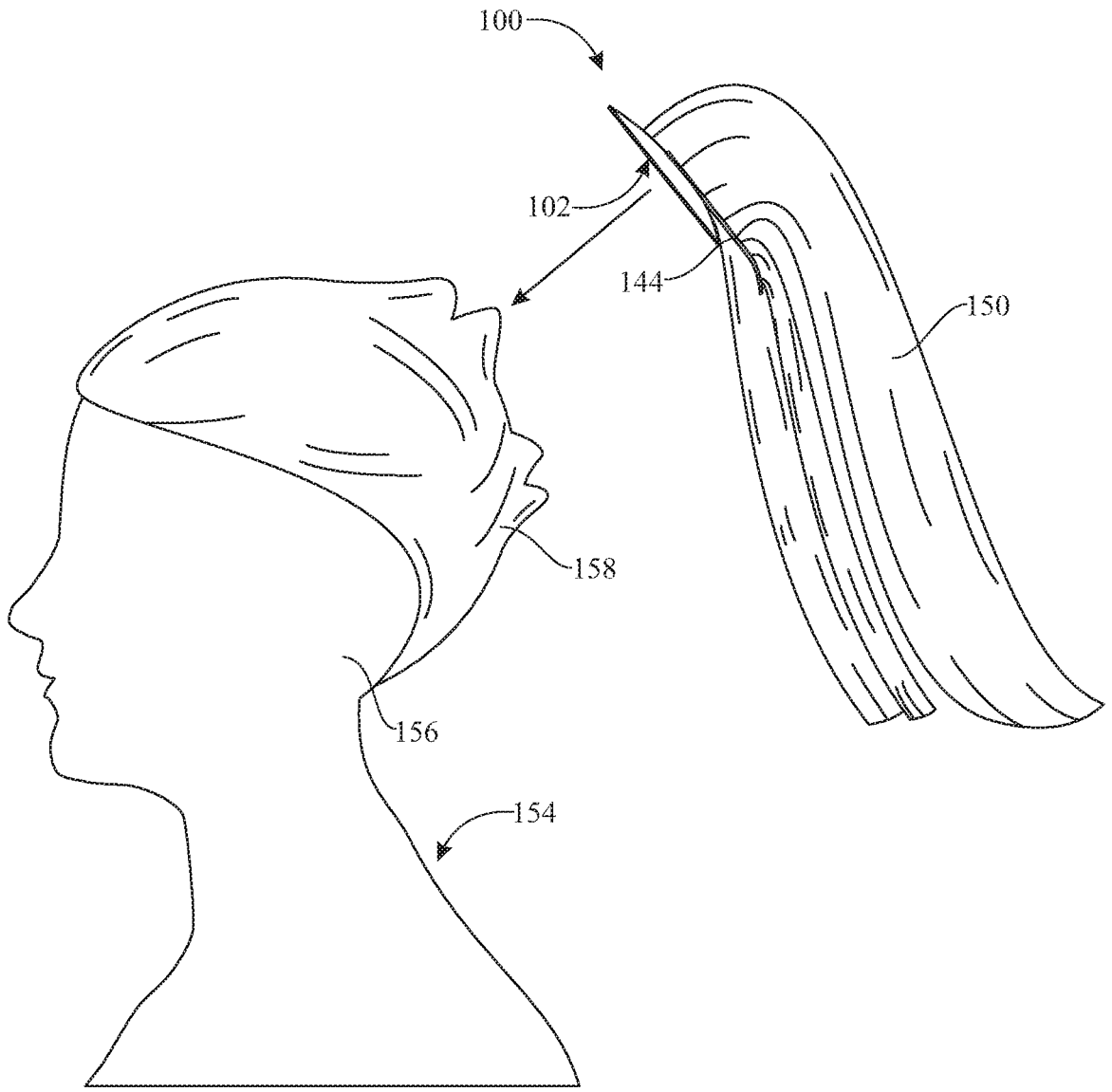
FIG. 4 presents an exploded side view showing typical attachment of the first illustrative embodiment of the hair augmentation system of the present invention to the natural hair of a wearer.
Figure 6:
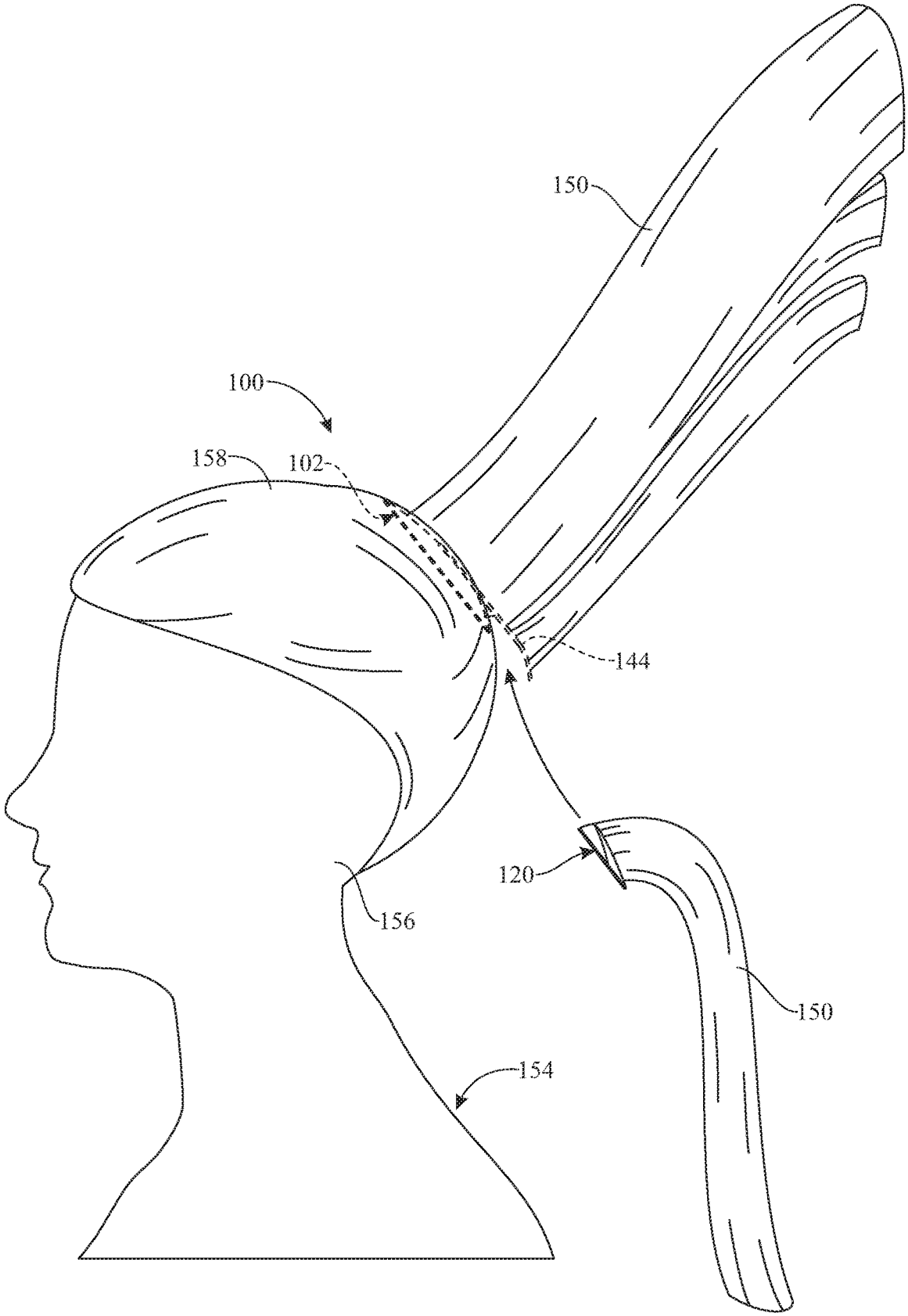
FIG. 6 presents an exploded side view of the first illustrative embodiment of the hair augmentation system of the present invention illustrating deployment of the clip portion after the natural hair of the wearer is accommodated under the hair flap on the main portion.

As further illustrated in FIG. 3, in some embodiments, imitation hair 150 having a selected color, coarseness and thickness may be attached to the outer surface 116 of the main portion 102 such as by gluing, stitching or the like. As illustrated in FIG. 6, in some embodiments, imitation hair 150 may additionally or alternatively be attached to the outer surface 116 of the clip portion 120. As illustrated in FIG. 4, still further, in some embodiments, imitation hair 150 may additionally or alternatively be attached to an inner surface, as illustrated, and/or an outer surface of the hair flap 144.

Figure 5:
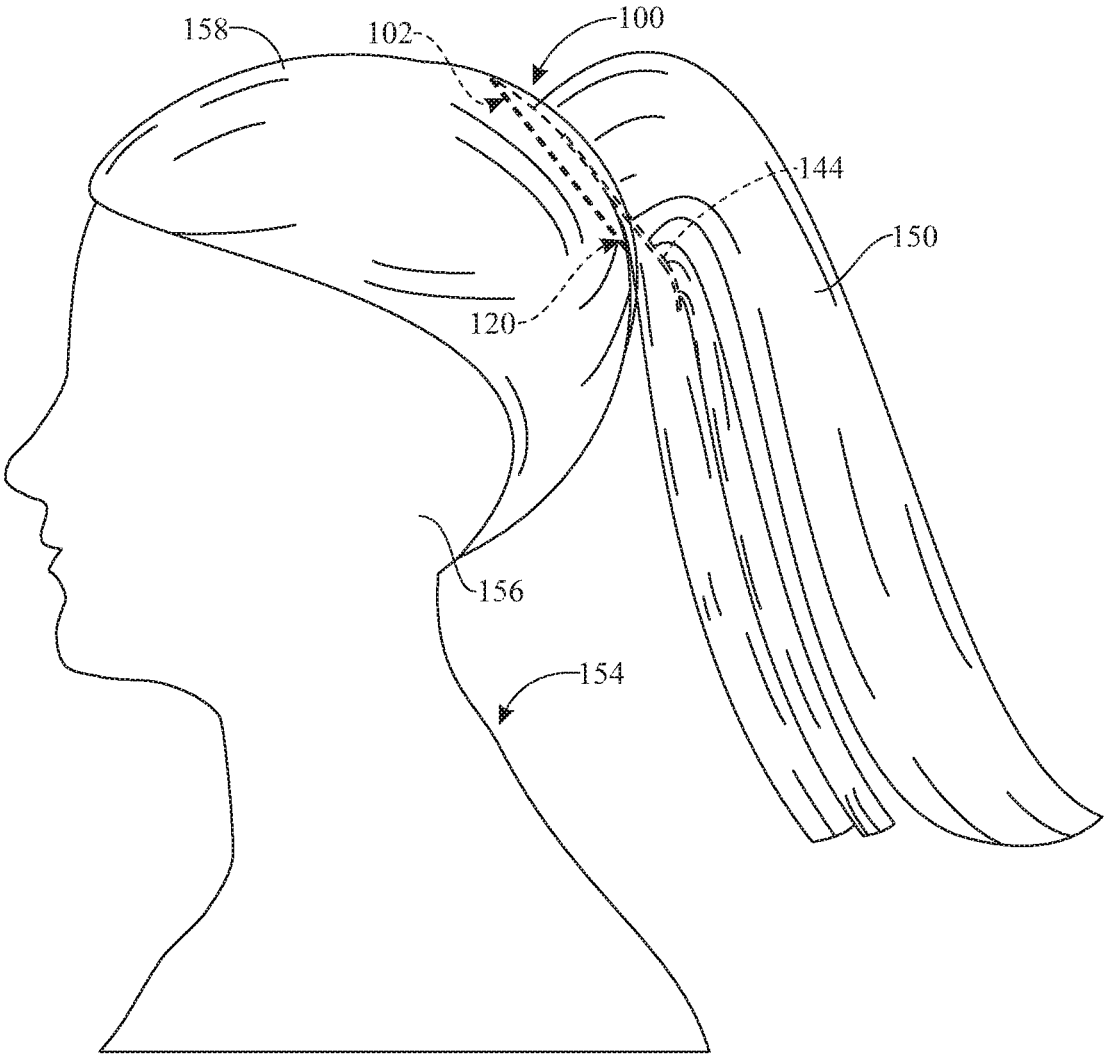
FIG. 5 presents a side view of the first illustrative embodiment of the hair augmentation system of the present invention attached to the natural hair of the wearer; with the wearer's natural hair extended over and around the main portion and the clip portion and merging with the imitation hair of the system.

As illustrated in FIGS. 4-8, in typical application of the hair augmentation system 100, the main portion 102 may be attached to the natural hair 158 on the head 156 of a wearer 154 using the hair clips 134 and the hair comb 140 (FIG. 1), as illustrated in FIG. 4. The natural hair 158 of the wearer 154 may be extended over and around the main portion 102 and merged or mixed with the imitation hair 150, as illustrated in FIG. 5. Alternatively, the wearer 154 may tuck his or her natural hair 158 inside the main portion 102 and underneath the hair flap 144. It will be appreciated by those skilled in the art that the hair flap 144 may have a flexible construction and may be pivotally attached to the main portion 102 via the flap stitching 146 (FIG. 3) may enable the adjacent flap cavity 112 (FIG. 2) to accommodate various quantities of the wearer's natural hair 158 and/or the imitation hair 150 underneath the hair flap 144.

Figure 7:
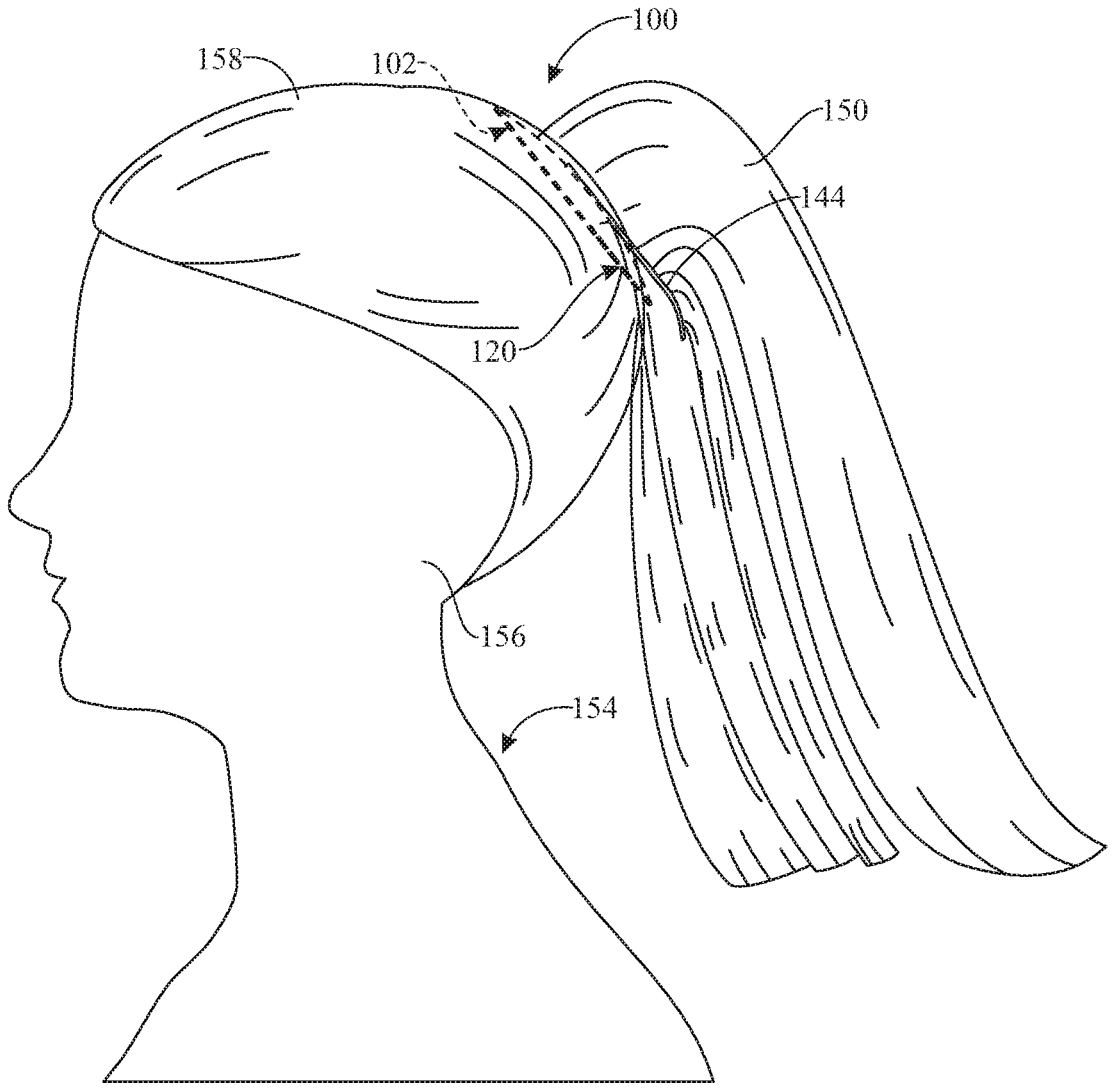
FIG. 7 presents a side view of the assembled and deployed first illustrative embodiment of the hair augmentation system of the present invention.
Figure 8:
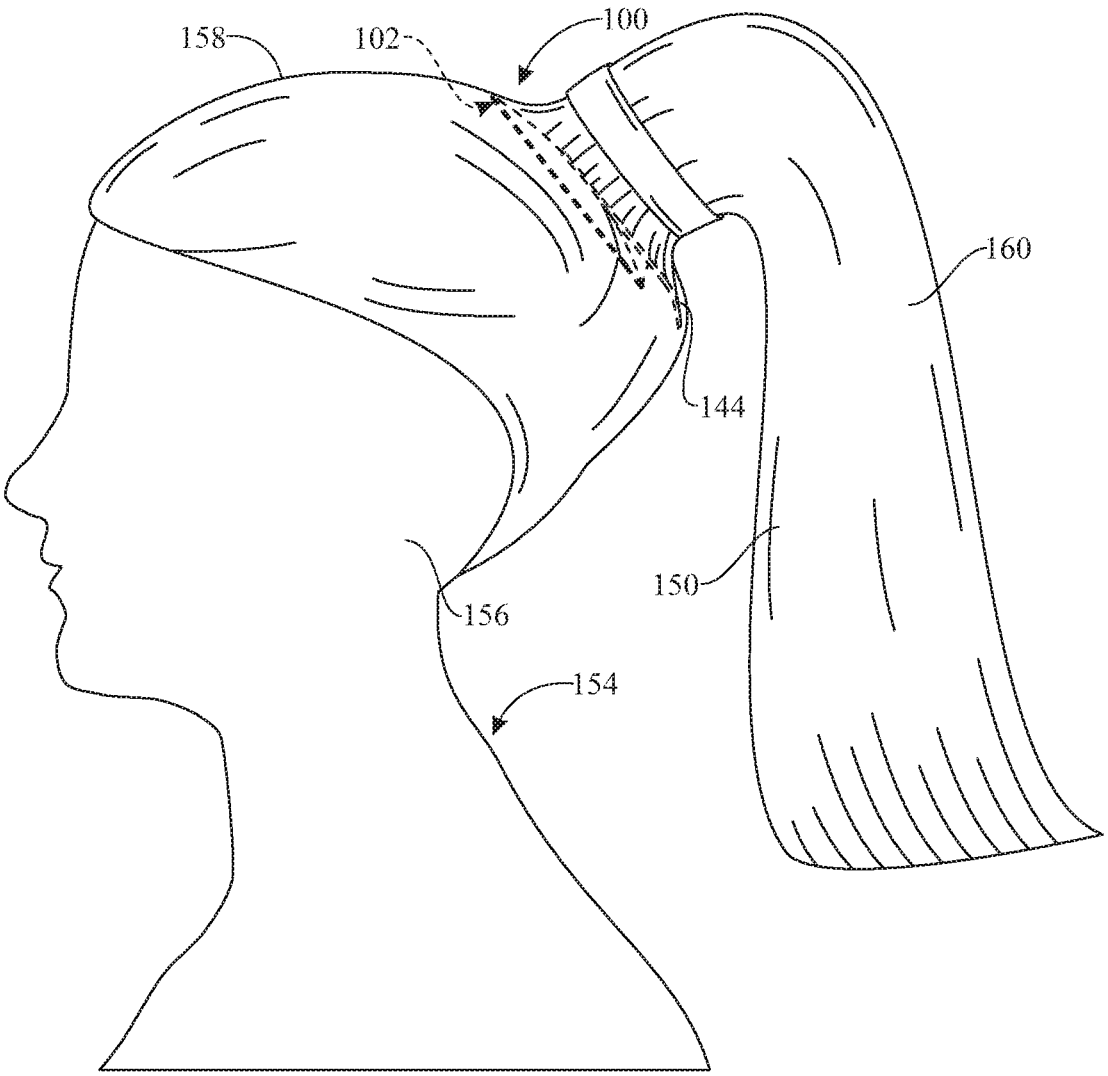
FIG. 8 presents a side view of the assembled and deployed first illustrative embodiment of the hair augmentation system, with the wearer's natural hair and the imitation hair of the system styled into a ponytail.

Once the wearer's natural hair 158 is accommodated underneath the hair flap 144, the clip portion 120 may be inserted in the clip notch 108 (FIG. 2) in the main portion 102, as illustrated in FIG. 6. Imitation hair 150 attached to the clip portion 120 may stream beneath the mixed stream of imitation hair 150 attached to the main portion 102 and the wearer's natural hair 158, as illustrated in FIG. 7, or may alternatively be mixed with the stream of imitation hair 150 and natural hair 158. As illustrated in FIG. 8, in some applications, the imitation hair 150 and the wearer's natural hair 158 may be styled to form a ponytail 160, or alternatively, French braids, a bun or other hair feature (not illustrated).

In another example of use, the wearers natural (real) hair may be configured in a pony-tail, and the pony tail may extend through the notch, or a space between the clip portion 120 and the main portion 102, such that the wearer's hair is bundles between the artificial hair of the main portion 102 and the clip portion 120. This provides a superior fullness compared to prior solutions, because the user's hair blends with the hair extensions without needing to be hidden flat to the wearer's head. In other words, the wearer's ponytail may extend along with the artificial hair of the system, providing a drastically full look. For example, the artificial hair on the flap 144 will lie above the user's real pony-tail, being supported by the real pony-tail, which adds a substantial fullness to the look of the user's natural ponytail.

Figure 9:
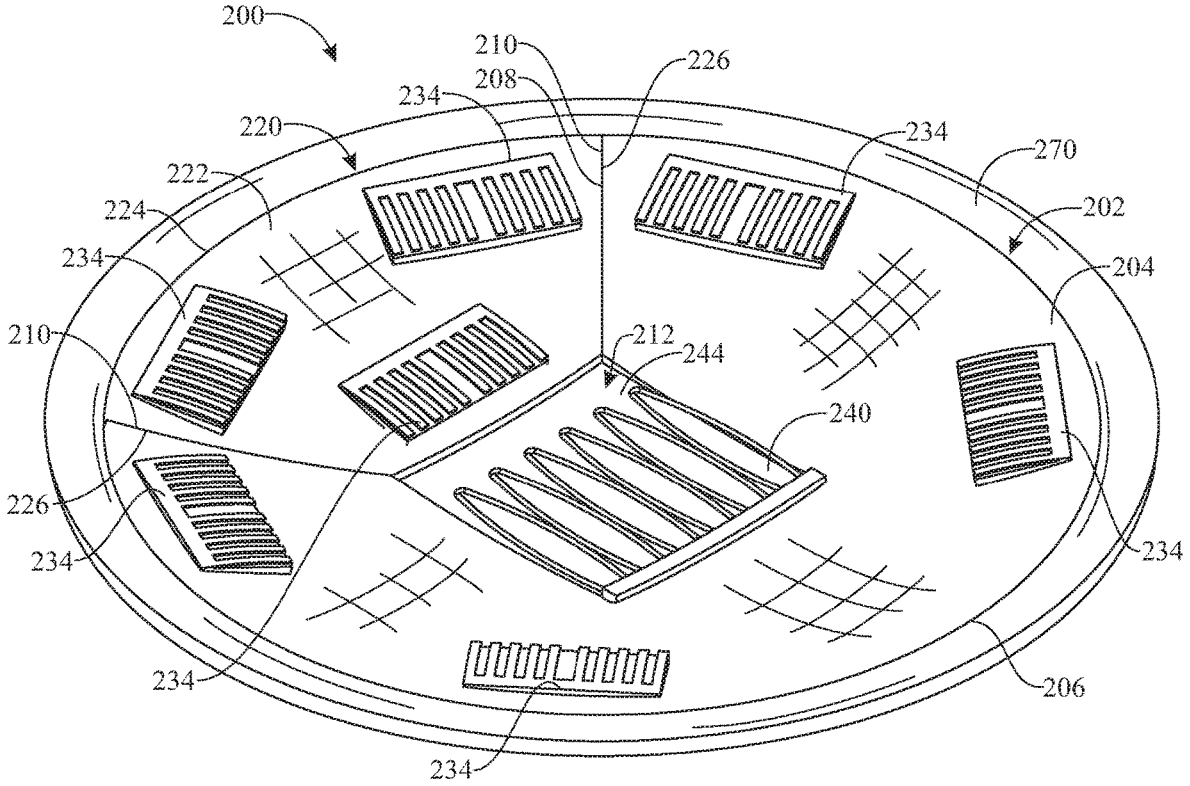
FIG. 9 presents a front perspective view showing a main portion and a complementary clip portion of a second illustrative embodiment of the hair augmentation system of the present invention.

Referring next to FIG. 9, a second illustrative embodiment of a hair augmentation system of the present invention is generally indicated by reference numeral 200. In the hair augmentation system 200, like reference numerals in the 200-299 series refer to like elements indicated by the corresponding reference numerals 100-199 in the hair augmentation system 100 which was heretofore described with respect to FIGS. 1-8.

Similarly to the previous embodiment, the hair augmentation system 200 of the present embodiment allows to cover and extend the appearance of a wearer's own natural hair without having to necessarily configure the wearer's natural hair to a desired hairstyle. The hair augmentation system 200 comprises a main portion 202 and a removable clip portion 220. The main portion 202 has a clip notch 208. The removable clip portion 220 complements the clip notch 208 of the main portion 202. The main portion 202 and the clip portion 220 together have a concave inner surface and a convex outer surface (not numbered). At least one hair clip 234 is provided on the inner surface of each of the main portion 202 and the clip portion 220. A flap cavity is formed in the main portion, and a hair flap 244 is carried by the main portion 200 at the flap cavity. At least one hair comb 240 is provided at the flap cavity, on or adjacent to the hair flap 244. Finally, though not shown, imitation hair is provided at least on the outer surface of the main portion 202.

In the present embodiment, an outer compressible edge 270 may extend from the main portion outer edge 206 on the main portion panel 204 of the main portion 202 and from the clip portion outer edge 224 on the clip portion panel 222 of the clip portion 220.

Application of the hair augmentation system 200 may be as was heretofore described with respect to the hair augmentation system 100 in FIGS. 4-8. Accordingly, the outer compressible edge 270 may enable the main portion 102 and the clip portion 120 to rest more comfortably on the scalp on the head 156 of the wearer 154.

It must be noted that the invention may also be used for creating other hair styles alternatively or in addition to a ponytail. For instance and without limitation, the invention can be utilized for providing a user with artificial French braids.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A hair augmentation system, comprising:

a main portion;

a clip notch in the main portion;

a removable clip portion complementing the clip notch in the main portion, the removable clip portion comprising an arcuate outer edge, an opposite substantially linear inner edge, and a pair of opposite side edges, the pair of opposite side edges tapering inwardly from the arcuate outer edge toward the inner edge of the removable clip, the main portion and the clip portion together having a concave inner surface and a convex outer surface;

at least one hair clip on the inner surface of at least one of the main portion and the clip portion;

a flap cavity in the main portion; and a hair flap hingeably attached to the convex outer surface of the main portion at the flap cavity, wherein the hair flap is attachable to the main portion and a portion of the hair flap extends a length beyond the arcuate outer edge of the main portion and, wherein the main portion and the clip portion are configured to fit together with the portion of the hair flap extending beyond the arcuate outer edge to remain free-flowing, and wherein the hair augmentation system interacts with a wearer's hair.

2. The system of claim 1, wherein the hair augmentation system further includes at least one hair comb at the flap cavity, at least one of on and adjacent to the hair flap.

3. The system of claim 1, wherein the hair augmentation system further includes imitation hair on the outer surface of the main portion.

4. The system of claim 1, wherein the main portion and the clip portion together have a circular dish shape.

5. The system of claim 1, wherein the main portion has a main portion panel with at least one of a semicircular and arcuate main portion outer edge.

6. The system of claim 1, wherein the clip notch in the main portion is wedge-shaped with a pair of angled notch edges extending from the main portion outer edge.

7. The system of claim 1, wherein the flap cavity is generally at least one of square and rectangular.

8. The system of claim 1, wherein the flap cavity communicates with the clip notch.

9. The system of claim 1, wherein the hair flap is attached to the convex outer surface of the main portion at the flap cavity.

10. The system of claim 1, wherein the at least one hair clip on the inner surface of each of the main portion and the clip portion comprises a plurality of hair clips adjacent to the main portion outer edge of the main portion.

11. The system of claim 1, wherein the at least one hair clip on the inner surface of each of the main portion and the clip portion comprises a plurality of hair clips adjacent to the clip portion outer edge and at least one hair clip adjacent to the clip portion inner edge of the clip portion.

12. The system of claim 1, wherein at least one of the main portion and the clip portion includes a compressible edge to more comfortably rest the system on a wearer's head.

13. A hair augmentation system, comprising:

a main portion;

a clip notch in the main portion;

a removable clip portion complementing the clip notch in the main portion, the removable clip portion comprising an arcuate outer edge, an opposite substantially linear inner edge, and a pair of opposite side edges, the pair of opposite side edges tapering inwardly from the arcuate outer edge toward the inner edge of the removable clip, the main portion and the clip portion together having a concave inner surface and a convex outer surface, wherein the arcuate outer edge of the removable clip provides a contiguous arcuate edge with an arcuate outer edge of the main portion;

at least one hair clip on the inner surface of at least one of the main portion and the clip portion;

a flap cavity in the main portion;

a hair flap having a first end and a second end, the first end hingeably stitched to the convex outer surface along a lateral axis normal to a longitudinal edge of the hair flap on the main portion at the flap cavity, wherein the hair flap includes a substantially rectangular-shaped body and when attached to the main portion a portion of the hair flap extends a length beyond the arcuate outer edge of the main portion;

wherein the second end of the hair flap is unattached to the main portion and free-flowing;

wherein the hair augmentation system further includes at least one hair comb at the flap cavity, at least one of on and adjacent to the hair flap;

wherein the hair augmentation system further includes imitation hair on the outer surface of the main portion;

wherein the main portion and the clip portion together have a circular dish shape;

wherein the clip notch in the main portion is wedge-shaped with a pair of angled notch edges extending from the main portion outer edge;

wherein the flap cavity is generally at least one of square and rectangular;

wherein the flap cavity communicates with the clip notch;

wherein a cushioned member is attachable to the concave inner surface of the main portion and the removable clip portion, the cushioned member positionable substantially proximate to the arcuate outer edge of the removable clip portion and the arcuate outer edge of the main portion; and wherein the cushioned member is compressible to external forces to provide a user with comfortable support when donning the hair augmentation system.

14. The system of claim 13, wherein the at least one hair clip on the inner surface of each of the main portion and the clip portion comprises a plurality of hair clips adjacent to the main portion outer edge of the main portion.

15. The system of claim 13, wherein the at least one hair clip on the inner surface of each of the main portion and the clip portion comprises a plurality of hair clips adjacent to the clip portion outer edge and at least one hair clip adjacent to the clip portion inner edge of the clip portion.

* * * * *